US006374716B1

(12) United States Patent
Weber et al.

(10) Patent No.: US 6,374,716 B1
(45) Date of Patent: Apr. 23, 2002

(54) HIGH SPEED HARVESTER CUTTING CHAIN

(75) Inventors: Johann Weber, Estacada, OR (US); Michael J. Patterson, Vancouver, WA (US); Arvin A. Hille, West Linn, OR (US)

(73) Assignee: Blount, Inc., Portland, OR (US)

( * ) Notice: Subject to any disclaimer, the term of this patent is extended or adjusted under 35 U.S.C. 154(b) by 0 days.

(21) Appl. No.: 09/514,986

(22) Filed: Feb. 29, 2000

(51) Int. Cl.[7] ..... B27B 33/14

(52) U.S. Cl. ..... 83/833; 83/834; 83/830; 83/839

(58) Field of Search ..... 83/830, 832, 833, 83/834, 839, 835

(56) References Cited

U.S. PATENT DOCUMENTS

| | | | | | |
|---|---|---|---|---|---|
| 2,897,857 | A | | 8/1959 | Carlton | |
| 2,923,329 | A | * | 2/1960 | Gudmundsen | 83/834 |
| 3,291,169 | A | | 12/1966 | Morner | |
| 3,929,049 | A | | 12/1975 | Graversen | |
| 4,425,830 | A | * | 1/1984 | Atkinson | 83/833 |
| 4,581,968 | A | * | 4/1986 | Gibson et al. | 83/833 |
| 4,702,139 | A | * | 10/1987 | Nagashima | 83/830 |
| 5,092,211 | A | * | 3/1992 | Petrovich et al. | 83/830 |
| 5,165,318 | A | * | 11/1992 | Wesley | 83/834 |
| 5,666,871 | A | * | 9/1997 | Burrows et al. | 83/834 |
| 5,740,715 | A | * | 4/1998 | Burrows et al. | 83/834 |
| 5,974,933 | A | * | 11/1999 | Burrows et al. | 83/834 |
| 6,058,825 | A | * | 5/2000 | Harfst | 83/834 |

* cited by examiner

*Primary Examiner*—M. Rachuba
*Assistant Examiner*—Kim Ngoc Tran
(74) *Attorney, Agent, or Firm*—Robert L. Harrington

(57) ABSTRACT

A high speed harvester cutting chain has increased cutter height to provide an increased space for removal of the cut material from the saw kerf. The increased height of the cutter links eliminates the compacting of the material cut away by the cutter links between the saw chain and the base of the saw kerf. The foot of the cutter links are flared outward to contact the guide bar rails at a different position than the tie straps to increase the wear life of the guide bar and saw chain.

4 Claims, 1 Drawing Sheet

HIGH SPEED HARVESTER CUTTING CHAIN

FIELD OF THE INVENTION

This invention relates to saw chain designed specifically for tree harvesters and more particularly to achieve more rapid cutting by a tree harvester.

BACKGROUND OF THE INVENTION

Tree harvesters using saw chain for cutting have been developed for cutting trees and particularly small diameter trees, e.g., 10–20 inches in diameter but which may be as large as 30 inches and greater. Tree harvesters are designed not only to fell the trees but also to delimb the trees and buck the trees to length.

Tree harvesters using cutting chain are in general of two different types. One type uses a cutting saw that is massive. The saw is equipped with a thick guide bar and a large sized saw chain, e.g., having a 0.750 inch pitch. More popular in many parts of the world is the second type using a smaller chain saw having a smaller thickness guide bar and a saw chain, e.g., of 0.404 inch pitch. It is the latter tree harvester to which the present invention is primarily directed.

Whereas cutting speed is important and desirable for overall efficiency in cutting the greatest number of trees, it is also important to the quality of the harvest. A tree harvester has a harvester head including a chain saw and grapple which may also include feed rollers and delimbing mechanism. (Such is referred to as a single head or single grip harvester. A double grip harvester, to which the invention may also apply, involves a second grapple that provides the delimbing function. The single grip grapple clamps onto a tree, the saw which is located below the grapple saws off the tree at its base and the tree is laid over on its side. The tree is fed through the grapple by the feed rollers while limbs on the tree are severed by the delimbing mechanism. As a specified length is fed through the grapple and past the chain saw, the chain saw is activated to cut the tree into lengths (referred to as bucking). Assuming that the specified lengths to be cut are eight feet (by way of example only), as the bucking cut is commenced there is no support along this eight foot length except the cantilever support provided by the securement of that length to the remainder of the tree which is held by the grapple. As the chain saw cuts through the tree thickness, the cantilever support becomes less and less of the tree thickness but which has to support the total weight of the eight foot length. Prior to completion of the bucking cut, the tree (or log as it may now be called) may split and often does.

There are a number of possible solutions to minimizing the occurrence of splitting but an important one is to increase the speed of cutting and thereby reduce the time in which the partially severed tree is required to support the cantilevered portion. It is theorized that a fast enough cut will achieve total severing of the log or tree before the weight of the cantilevered portion will be applied as a bending and breaking force to the partial cut. Studies have been conducted and although the findings are more theoretical than factual, at least for one of the studies it has been concluded that a saw chain that will cut through a 35 centimeters (cm) diameter log in 0.8 second will dramatically reduce the occurrence of log splitting in the bucking operation. Other studies use different parameters for determining a targeted performance standard. The objective is to achieve an optimum speed at which the tree can be cut to reduce splitting.

Each cutting link in a harvester saw chain functions as an individual cutter that removes a small ribbon of material, e.g., having a thickness of 0.050 inch and a width of half the thickness of the kerf being cut (the cutters alternate between right hand and left hand cutters and cooperatively cut the total kerf width). The greater the number of cutters that pass through a log in a given time, the faster the cut. The smaller the chain pitch, the greater the number of cutters per given length of chain. Thus, it was reasoned that running a small pitch chain at a maximum speed would produce the fastest cutting time. It is also noted that a lower mass can be safely run faster than a larger mass and this too is a plus for the smaller pitch chain.

The industry has succeeded in driving the saw chain at what is considered the maximum speed (to accommodate safety concerns and avoid excessive abuse to the equipment). Cutting time has been decreased to between one and two seconds (for cutting a 35 cm tree or log) but that time continues to be greater than the desired time. The industry in effect hit a wall as far as decreasing the cutting time by sheer chain speed and further improvement was directed at a redesign of the cutting chain.

The 0.404 pitch cutting chain was originally designed for hand held chain saws and that design was substantially adopted, as is, for use in harvesters. The only changes were (a) to change the depth gauge setting (from about 0.030, in stages, to about 0.050 inch) to allow chain cutters to take a bigger bite into the kerf, (b) to increase the material under the rivet holes to accommodate the greater wearing that occurred because of the pressure applied between the footprint of the chain (the bottom bearing surface) and the bar rails and (c) to provide a thicker drive link, i.e., to fit a bar groove of 0.080 inch width.

During use of the 0.404 chain in tree harvesters and because safety concerns such as kick back are not applicable to harvester cutting, experimental changes were made in an attempt to make the cutters more aggressive (the cutting teeth being set to cut more deeply and thereby, presumably, to take a greater bite into the wood). Of the numerous changes tried (over a period of many months), none achieved appreciable improvement in cutting time until the present invention.

BRIEF DESCRIPTION OF THE INVENTION

It was determined that modifications to the traditional cutter to make it more aggressive did not change cutting speed because the forces applied by the harvester simply powered the cutters into cutting the maximum depth permitted by the depth gauge. Accordingly, it was found that the aggressiveness or non-aggressiveness of the cutters was not a factor. A further consideration was to increase the permitted depth of cut, i.e., by further lowering the depth gauge. However, that too was found not to provide the desired cutting speed improvement.

Whereas it is essentially impossible to examine the cutters in action on a harvester (or even a laboratory simulation thereof), it was theorized that what has to be taking place is that the chip carrying capacity of the chain is being exceeded. The chain consists of a sequence of interconnected links including a pair of side links in side-by-side relation including a cutter and a tie strap, a center/drive link, a pair of side-by-side tie straps and then a further center link. The latter center link is connected to a following but similar sequence of links and so on around the loop of chain. Each sequence as described alternately has a right hand cutter link and then a left hand cutter link.

Each sequence of links as described is considered to define a carrier space that extends from the cutting edge of one cutter link to the cutting edge of the following cutter link. In cross section the carrier space is defined by the kerf and the height of the tie strap. This space is illustrated in the schematic views of FIGS. 2 and 3 with letter "a" of FIG. 3 indicating the length and letters "b" and "c" of FIG. 2 indicating the depth and width of the chip carrier space.

Particularly in the power cutting action of a tree harvester, the chain is held continuously against the bottom of the kerf and the chips are largely confined in the described carrier space. When that space is filled with chips, the chips compact and then force the chain out of contact with the bottom of the kerf and the cutting process is diminished. No amount of extra speed or increase in depth gauge setting or increase in cutter aggressiveness will enable efficient cutting until the chips are released, i.e., when the chain exits the kerf. It is, therefore, the objective of the present invention to increase the carrier space which will theoretically extend the time in which a cutter can continue cutting before the chip carrying capacity is exceeded, and thus enable an overall reduction in cutting time.

An apparent solution to increased carrier space is to lengthen the distance "a" between the cutters. However, this translates into fewer cutters doing the cutting in a given number of revolutions of the chain and slows rather than speeds up the cutting process. Widening the kerf is also not productive as this requires the cutting of more wood for the same depth of cut. The remaining option is to increase elevation or height of the cutter teeth, i.e., distance "b". It is well known that saw chain has been developed to have a very balanced configuration and added height produces increased and unwanted leverage as the cutting tooth tries to pivot rearwardly. When the cutters pivot rearward, the depth gauge elevates and forces a shallower cut. Chain cutting also becomes rougher and breakage more likely.

The possible answer to the above difficulties is again the effect of the vastly superior forces applied in harvester cutting. If these forces are sufficient to prevent rearward pivoting of the cutter then the objective of enhanced carrier space may be achieved.

The height of the cutter was cautiously increased in increments and tested. An example of an increased cutter height is shown in FIG. 2. It was learned that with each incremental increase the cutting speed increased without any detrimental affect from cutter rear back. Height b was increased from about 0.175 inch to 0.280 inch and at that point the cutter continued to perform well and the theoretical cutting capability of the chain for cutting a 35 cm diameter log was achieved. That is, if one assumes that each cutter removes a 0.050 thickness ribbon of material in each pass through the kerf (the depth permitted by the depth gauge), if it is known how fast the chain is run and then the number of times a cutter passes through the kerf (cumulatively) in a given time, one can calculate the time it should take to cut a known tree diameter. Such performance has not been achieved with prior saw chain designs. The cutting speed of the improved chain has been increased at least 20% over existing saw chain, i.e., very close to the theoretical maximum cutting speed and the industry objective of cutting a 35 cm log in 0.8 seconds can now be satisfied.

Because the saw chains of this invention were developed for hand held saws where performance was not constrained by chip capacity but were constrained by such factors as roughness and safety, the optimum design dictated a height "b" to be maintained at less than about 60% of the pitch. The chain of the present invention is designed specifically for harvester cutting and is believed to provide the most effective cutting with the height "b" at about 85% of the pitch. At 100%, the cutter is believed to become unwieldy and breakage is a concern but anything greater than about 75% and not exceeding 100% provides the desired improvement in cutting speed.

Whereas wearing of the bearing surface located between the bar rails and the footprint of the side links is a concern (recall the prior comment that the material thickness under the rivet hole was increased for this reason) a further improvement has been made to alleviate wearing of the bar rails. Because the rails are wider than the footprint of the chain links, the footprints of the cutting links are flared outwardly to engage the outer portion of the bar rails. The footprints of the remaining side links (tie straps) engage the inner portion of the rail edge. This evens the wear of the bar rails and substantially reduces the problem of guide bar rail wearing.

The invention will be more fully appreciated upon reference to the following detailed description having reference to the drawings referred to therein.

DESCRIPTION OF THE PREFERRED EMBODIMENT

Figure 1:
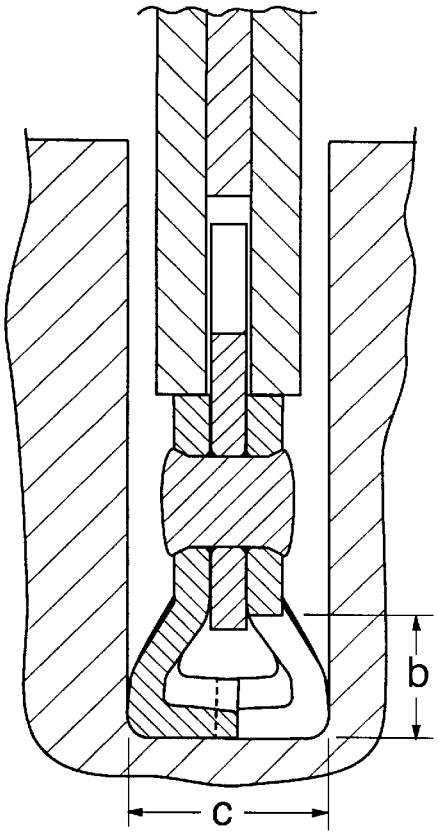
FIG. 1 Prior Art
FIG. 1 is a sectional view of a saw chain of the prior art shown in operation in a kerf being cut in a log or tree.
Figure 2:
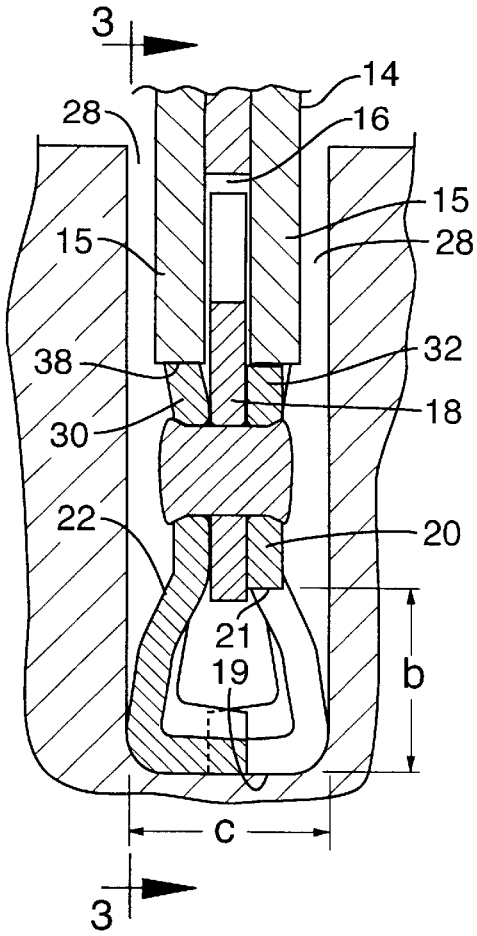
FIG. 2 is a similar view of a saw chain of the present invention.
Figure 3:
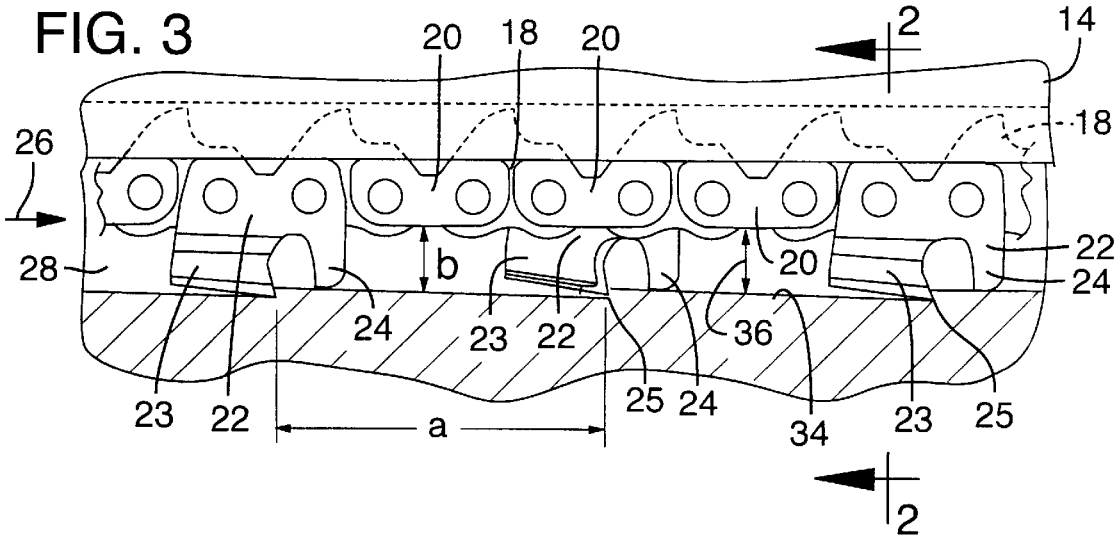
FIG. 3 is a side view of the saw chain of FIG. 2.

FIGS. 2 and 3 illustrate a portion of the saw chain of the present invention. The saw chain is mounted on a guide bar 14. As shown in FIG. 2, the guide bar 14 has a guide groove 16 in which the center drive links 18 of the saw chain travel. The center drive links 18 are interconnected by tie straps 20 and cutter links 22 as shown in FIG. 3.

Each of the cutter links 22 has a depth gauge 24 that determines the depth of cut that each of the cutter links will make as the saw chain is propelled around the guide bar 14.

The saw chain is propelled around the guide bar 14 by a known power head and is propelled in the direction as indicated by arrow 26. As the saw chain is propelled by the power head, the guide bar 14 forces the saw chain against the material and the cutting teeth 23 of the saw chain will generate or produce a saw kerf 28 as shown in FIG. 2. Each cutting tooth 23 will cut away a portion of the material with the depth of cut of the cutting teeth 23 being limited by the depth gauge 24.

One of the problems encountered with the high powered harvesting machines is the removal of the chips out of the saw kerf 28. It has been found that the chips generated by the cutting teeth 23 are sufficient in volume such that the chips will tend to limit the penetration of the cutting teeth 23 into the material. The chips produced by the cutting teeth 23 are believed to fill the space between the cutting edges 25 of the cutting teeth 23 and within the kerf (generally the volume aXbXc in the drawings) and when compacted force the chain away from the bottom of the kerf 34 as substantially illustrated by arrow 36 in FIG. 3.

The saw chain of the present invention has cutting teeth 23 that have a greater height than that of saw chain of the past. The greater height, generally indicated by b in FIG. 2 provides an increased depth that accommodates the chips generated by the cutter links 22. The increased height b in combination with the width c of the kerf 28 and the distance a between the successive cutting edges 25 provides for a large volume to receive the chips generated by the cutter links 22. The large volume reduces the compacting of the chips between the saw chain and the bottom of the kerf 28. Increasing the volume for chip removal has been found to increase the rate at which the saw chain will cut through a log.

The saw chain of the present invention is configured for harvester type machines and therefor there is not the concern for safety considerations such as kickback that is normally associated with hand held chain saws.

The harvester machines exert a large force on the guide bar and saw chain which tends to produce rapid wearing of the guide bar 14 at the bearing surface 38 of the rails 15. As previously discussed, the distance under the rivets of the chain links has been increased to accommodate greater wearing of the chain. In order to reduce the wear of the guide bar 14 the foot of the tie straps 20 and the foot of the cutter links 22 are arranged to engage the rails 15 of the guide bar 14 at different contact points. The rails 15 are the extension of the outer laminates of the guide bar 14 that define the guide groove 16 of the guide bar 14. This, of course, has reference to the laminated guide bar as illustrated. For a solid guide bar, the groove is cut into the edge and the rails are thereby formed at each side of the groove in substantially the same configuration. As shown in FIG. 2, the foot 30 of the cutter link 22 is flared outward so that the foot 30 of the cutter link 22 has a different contact position on the rail 15 than that of the foot 32 of the tie strap 20. Even though the foot 30 of the cutter link 22 has a portion in contact with the rail 15 that coincides with a portion of foot 32 of the tie strap in contact with the rail 15, there is enough variance to increase the life of the guide rails 15.

Those skilled in the art will recognize that modifications and variations may be made without departing from the true spirit and scope of the invention. The invention is therefore not to be limited to the embodiments described and illustrated but is to be determined from the appended claims.

The invention claimed is:

1. A high speed harvester cutting chain comprising:

a loop of interconnected links including a first sequence of links having a first pair of side links, one of said pair of side links being a left handed cutting link and the other a tie strap, a first center link overlapping and pivotally connected to the rear of said pair of side links and a second pair of side links both being tie straps and overlapping and pivotally connected to the rear of said first center link, and a second center link overlapping and pivotally connected to the rear of said pair of tie straps, said second center link being pivotally connected by front and rear rivets extended through each of the overlapping positions of the center link and side links;

a second sequence of links as described for said first sequence of links but including a right handed cutting link and a tie strap as the first pair of side links, and succeeding alternating first and second sequences of links all being interconnected to form said loop of interconnected links;

said left and right hand cutter links each including a cutting tooth preceded by a depth gauge and both the cutting tooth and depth gauge extended outwardly from an outer edge of the opposed tie straps, said extensions of cutting tooth and depth gauge being a separate and determined extension distance, the cutting tooth extended further than the depth gauge and the difference defining a depth of cut;

said pivotal connections linearly spaced apart and having an average spacing that defines the chain pitch, and said extension of the cutting teeth having a distance no less than about 75% of the chain pitch.

2. A high speed harvester chain as defined in claim 1 wherein said pitch is no greater than 0.5 inch and said extension of the cutting teeth being no greater than equal the pitch.

3. A high speed harvester chain as defined in claim 1 wherein said pitch is 0.404 inches and said extension of the cutting teeth is about 0.350 inch.

4. A high speed harvester chain as defined in claim 1 wherein the bottom edges of the cutting links are slightly transversely flared to vary the engagement of the side links with the bar rails.

* * * * *